United States Patent [19]

Adler

[11] 4,046,268

[45] Sept. 6, 1977

[54] HOPPER DOOR ACTUATING MECHANISM

[75] Inventor: Franklin P. Adler, Michigan City, Ind.

[73] Assignee: Pullman Incorporated, Chicago, Ill.

[21] Appl. No.: 706,868

[22] Filed: July 19, 1976

[51] Int. Cl.[2] ..... B65G 67/24

[52] U.S. Cl. ..... 214/58; 214/63; 105/241 C

[58] Field of Search ..... 214/58, 63; 105/241 C, 105/241 R, 251, 308 R, 310, 239, 280, 308 P, 306, 284, 283

[56] References Cited

U.S. PATENT DOCUMENTS

| | | | |
|---|---|---|---|
| 2,370,998 | 3/1954 | Schroeder | 105/241 C |
| 3,872,796 | 3/1975 | Adler | 105/299 |
| 3,994,238 | 11/1976 | Adler | 214/63 |

*Primary Examiner*—Robert J. Spar
*Assistant Examiner*—Lawrence E. Williams
*Attorney, Agent, or Firm*—Richard J. Myers

[57] ABSTRACT

A bottom dump hopper car having outwardly swinging clamshell doors includes a locking mechanism for maintaining a door in closed position by means of a stop and bracket arrangement. A vertically moveable arm is actuated to disengage the locking mechanism whereupon the door can swing outwardly as the arm swings in an outward path which is controlled by a ground mounted tripping mechanism.

12 Claims, 8 Drawing Figures

HOPPER DOOR ACTUATING MECHANISM

BACKGROUND OF THE INVENTION

1. Field of Invention

Broadly the field of invention to which the present construction pertains includes hopper cars of the bottom dump type. More specifically the invention relates to cars for discharging coal or other comminuted materials through lower openings normally closed by outwardly swinging clam shell doors.

2. Description of the Prior Art

The prior art is disclosed in U.S. Pat. Nos. 2,909,294, Oct. 20, 1959; 3,227,100 Jan. 4, 1966; 3,471,044, Oct. 7, 1969; 3,790,008, Feb. 5, 1974 and 3,633,772, Jan. 11, 1972. The present invention is an improvement over constructions similar to those shown in the aforementioned patent.

SUMMARY

In the present invention bottom dump doors of the clam shell type for coal cars and the like are locked in a closed position by means of a link which includes a stop that engages a stop bracket mounted on a lower portion of a car body. The link in turn is pivotally connected to an arm which is swingably connected to a car body. The arm is movable vertically whereby it disengages the link stop from the stop bracket thereby permitting the clam shell doors to be moved outwardly to an open position. The clam shell doors are of a type which are pivoted in over-center fashion with the load within the car body tending to keep the doors tightly closed. Thus the clam shell doors must be forcefully moved to the open position whereupon the load may be dumped. This is achieved by swinging the vertically movable arm laterally outwardly about its pivot by means of a ground mounted tripping mechanism. The tripping mechanism includes a flanged tripping track which is movable upwardly into engagement with a roller mounted on a lower portion of the vertically movable arm and causes the initial movement of said arm upwardly to disengage the stops holding the clam shell door in the closed position. The ground mounted tripping mechanism also includes a motor driven actuating mechanism which moves the arm laterally outwardly in guided fashion thereby opening the clam shell doors so that the load may be discharged.

A modified tripping arrangement for the above door lock mechanism described includes flanged track members positioned on the adjacent sides of the railway track which are movable into position to engage the tripping arms whereby the door lock is actuated to initiate movement of the clam shell doors to the outwardly extending and open position.

DESCRIPTION OF THE PREFERRED EMBODIMENT

Figure 1:
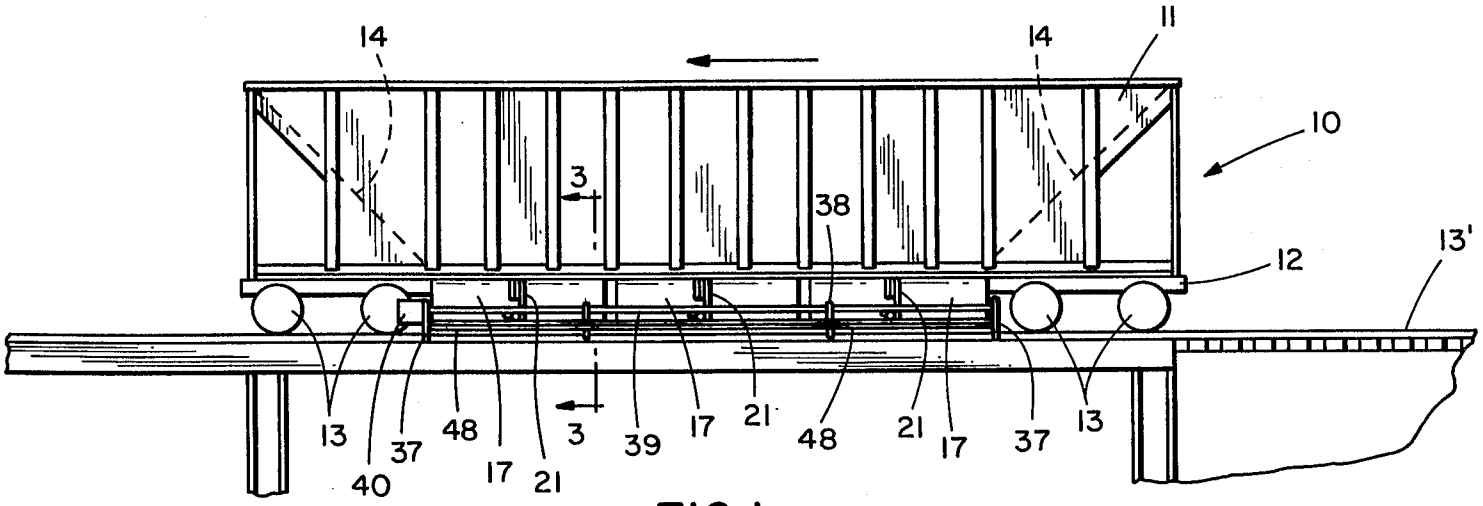
FIG. 1 is a side elevational view of a bottom dump hopper or coal car positioned over a pit and adjacent to a ground mounted tripping mechanism for actuating clam shell doors of the car.

FIGS. 1 through 4 disclose an open top railway hopper car 10 which includes a hopper body 11 having a conventional center sill underframe structure 12. The car 10 is of a type suitable for transporting coal and other comminuted materials and is supported on conventional wheel trucks 13 on a railway track 13'. The hopper shaped body 11 includes end slope sheets 14 and side slope sheets 15 terminating at their lower ends thereof in discharge openings 16.

Three longitudinally spaced discharge openings 16 are provided on opposite sides of the center sill and these are adapted to be closed by means of clam shell type doors 17.

Each of the clamshell doors 17 includes conventional vertical hangers 18 which are hingedly connected to lower divider bulkheads 20 and lower end sheets of the same configuration extending downwardly from the end slope sheets 14.

Figure 3:
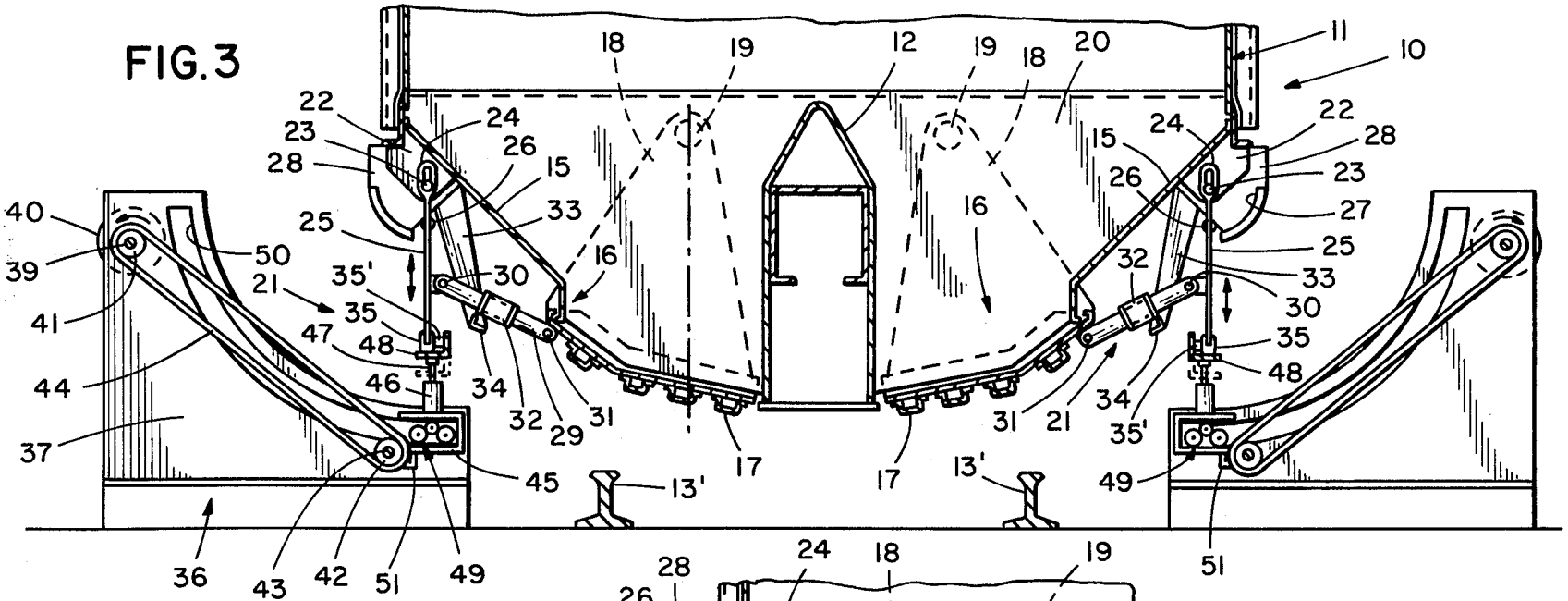
FIG. 3 is a cross sectional view taken substantially along line 3—3 of FIG. 1.
Figure 4:
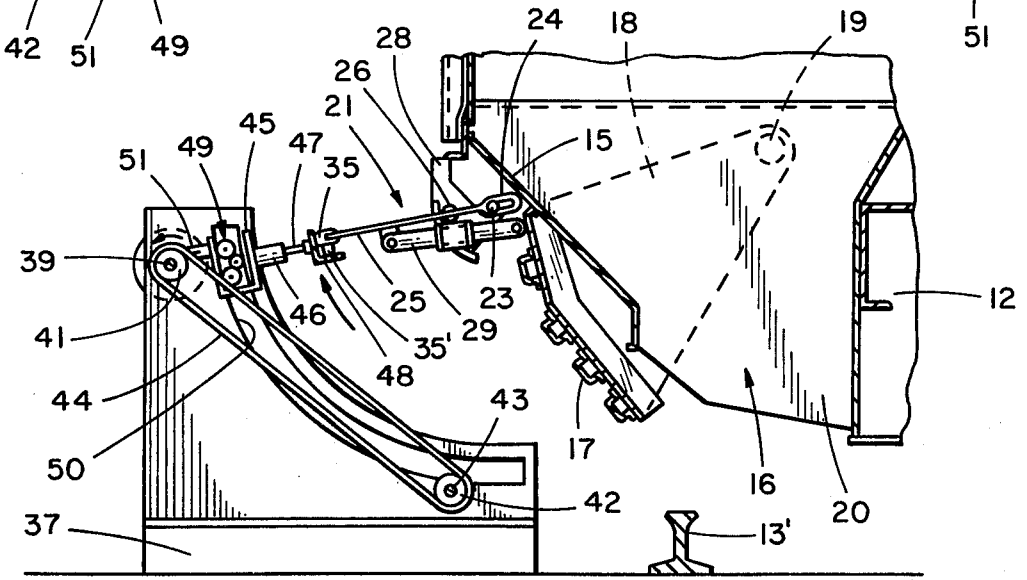
FIG. 4 is a cross sectional view similar to FIG. 3 showing another operating position of a door arrangement.

As best shown in FIGS. 3 and 4 a door actuating and locking mechanism 21 is provided for each door and includes a bracket 22 which is supported on a side sill and side slope sheets 15.

Each bracket 22 includes a pivot bolt 23 connected to an elongated looped end 24 of an arm 25 permitting pivotal and vertical movement of the arm 25. Each arm 25 also is provided with a roller guide 26 which is adapted during outward swinging movement of the arm 25 to engage and be guided by an arcuate track guide 27 supported on a bracket 28 also projecting downwardly from the side sill of the car.

A link 29 is pivotally connected at 30 to the vertically positioned arm 25 and is pivotally connected as indicated at 31 to one side of the clam shell door 17. Each link includes an adjustable stop 32 which in a locked position engages and is held within a flanged stop 34 of a bracket 33 rigidly secured to the slope sheet 15. The lower end of the arm 25 is provided with a roller 35 rotatable about a horizontal pivot axis on the arm 25. A second roller 35' is connected to the arm for rotational movement about a vertical axis.

Figure 2:
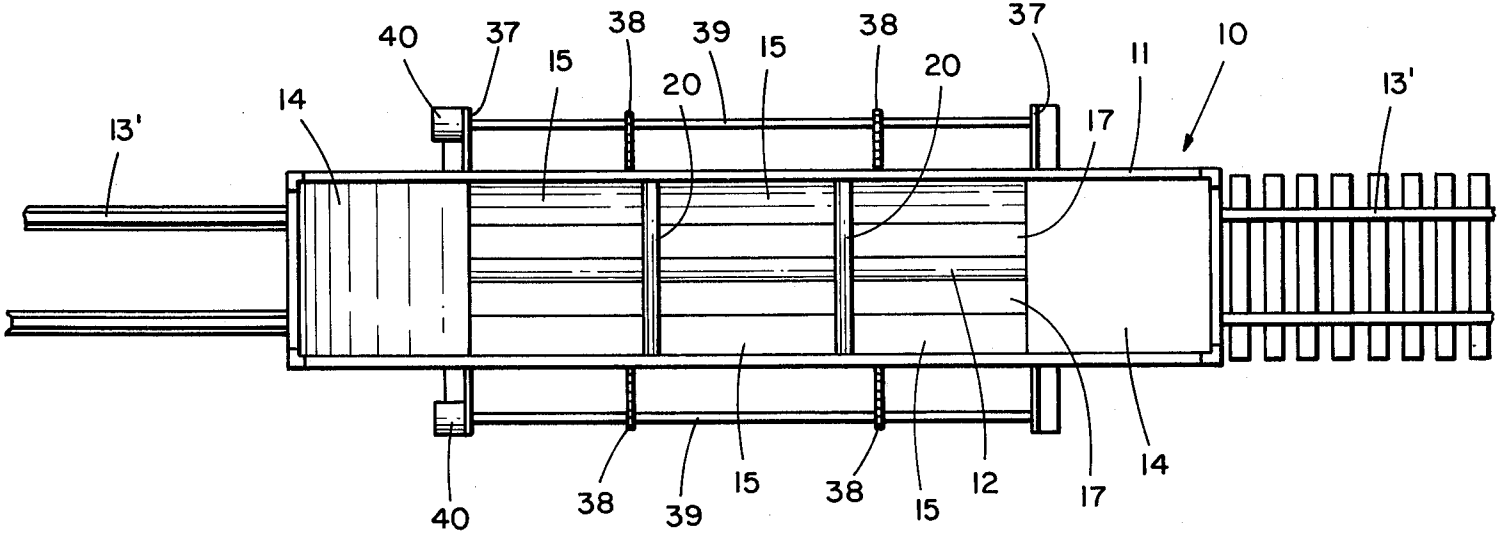
FIG. 2 is a plan view of the car and dumping arrangement shown in FIG. 1.

The door actuating and locking mechanism 21 also includes a ground mounted tripping mechanism generally designated at 36. Tripping mechanisms 36 on opposite sides of tracks 13' as best shown in FIG. 1 include end supports 37 and intermediate supports 38. A longitudinal drive shaft 39 is rotatably mounted on the supports 37 and 38 and is power operated by means of an electric motor 40 as best shown in FIG. 2. The electric motors 40 each drive a pulley 41 suitably mounted on each shaft 39 and end supports 37. Second pulleys 42 are rotated on shafts 43 also mounted on the spaced end supports 37. Endless drive belts 44 are trained about the pulleys 41 and 42 to be driven by the electric motor 40. The tripping mechanism 36 also includes, at opposite ends of supports 37, cylinder support assemblies 45, each including a hydraulic cylinder 46. The hydraulic cylinder support assemblies 45 are positioned adjacent to the end supports 37 and include piston rods 47 connected to a flanged tripping angle 48 which is movable vertically into engagement with the rollers 35 of each arm 25. The tripping angles extend longitudinally on opposite sides of the car for simultaneously opening all of the clam shell doors. Each cylinder support assembly 45 also includes a roller guide assembly 49 which projects outwardly from each and is held captive within an arcuate guide slot 50. Such a guide slot 50 is provided in each of the end supports 37 with the roller guide assemblies 49 of the two cylinder support assemblies 45 being slidingly and guidingly engaged within the slot 50.

OPERATION OF THE PREFERRED EMBODIMENT

FIGS. 1 and 2 disclose the coal car in position over an open pit or bin across which extends the railway track 13'. The clam shell doors are now moved to their open position so that the coal or other materials can be dumped through the tracks into the discharge bin. The operator now actuates the air cylinders 46. The cylinders 46 move the piston rods 47 upwardly whereupon the flange tripping angle 48 engages the rollers 35 of each of the arms 25. It will be noted that the elongated loop end 24 has its lower portion in engagement with the pivot bolt 23. The lost motion connection providing for upward movement of the adjustable link stop 32 as shown in FIG. 3. Since the stop 32 has moved away from the stop 34 the clam shell doors may now be opened outwardly to a dump position for discharging materials. The operator now actuates the reversible motor 40 which starts rotation of the belt 44. The belt 44 is pivotally connected by means of a pivot bracket 51, as best shown in FIGS. 3 and 4 to the hydraulic cylinder support assemblies 45 and upon actuation of the belt in counter clockwise direction the hydraulic support assemblies are moved upwardly in the manner shown in FIG. 4. The guide rollers 49 provide the support for the cylinders 46 and move into the position shown in FIG. 4 whereupon the clam shell doors are now completely opened. When the load has been completely dumped from the car the motors 40 are reversed and the doors are returned to the closed position whereupon they are again locked when the arm 25 assumes the vertically lowered position as the flange tripping angle 48 is lowered to the dotted line position by gravity as shown in FIG. 3 whereupon the doors are again in a completely locked position. The piston rods 47 also are retracted by gravity since air pressure has been exhausted from the cylinders.

DESCRIPTION AND OPERATION OF MODIFIED EMBODIMENT

Figure 5:
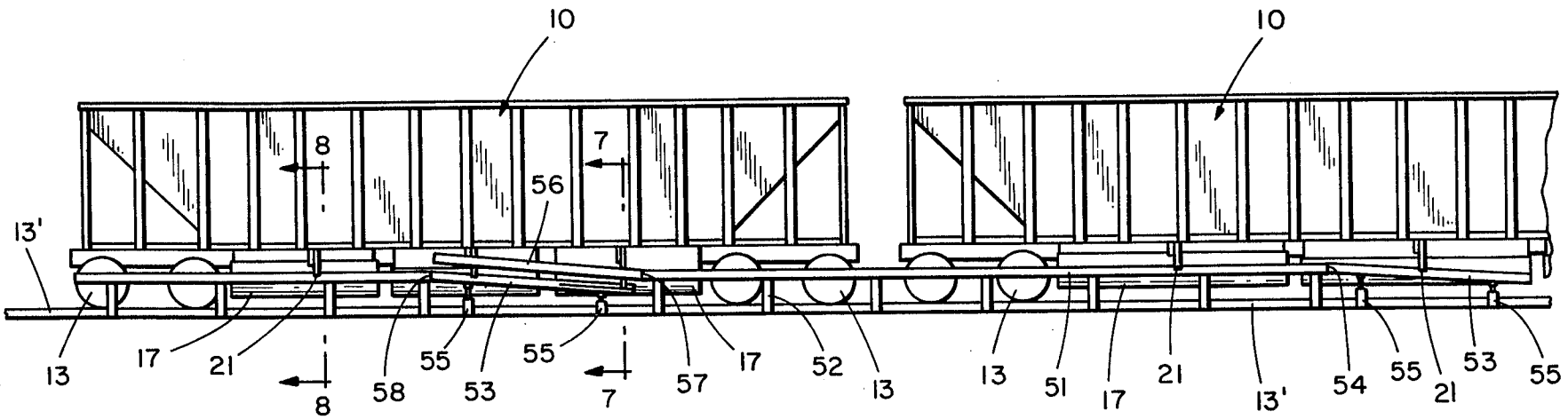
FIG. 5 is a side elevational view of two railway cars of the type disclosed in FIG. 1. positioned relative to a modified door tripping mechanism view of the car arrangement shown in FIG. 5.
Figure 6:
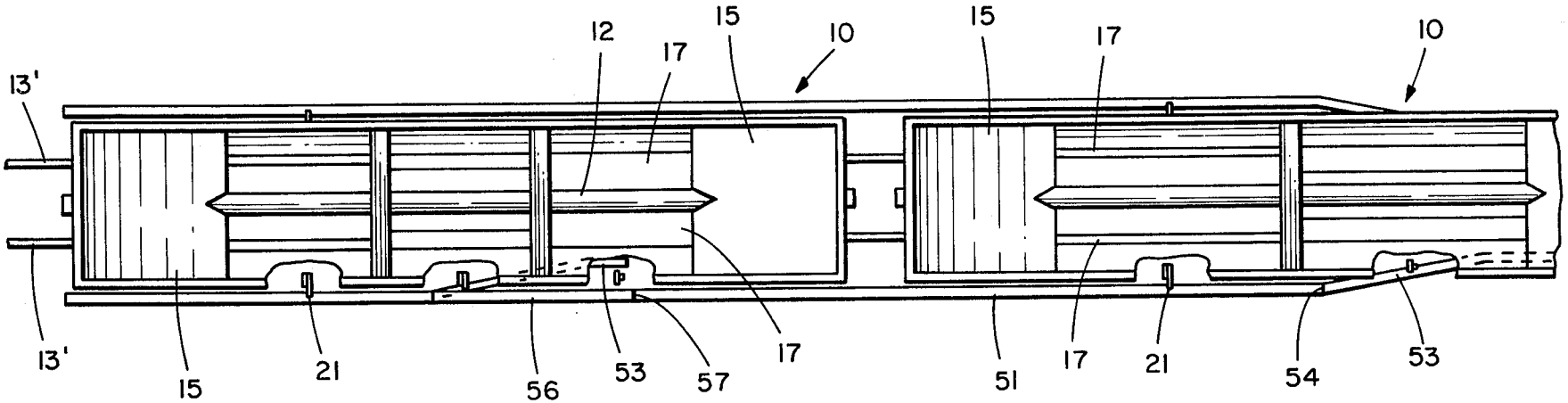
Figure 7:
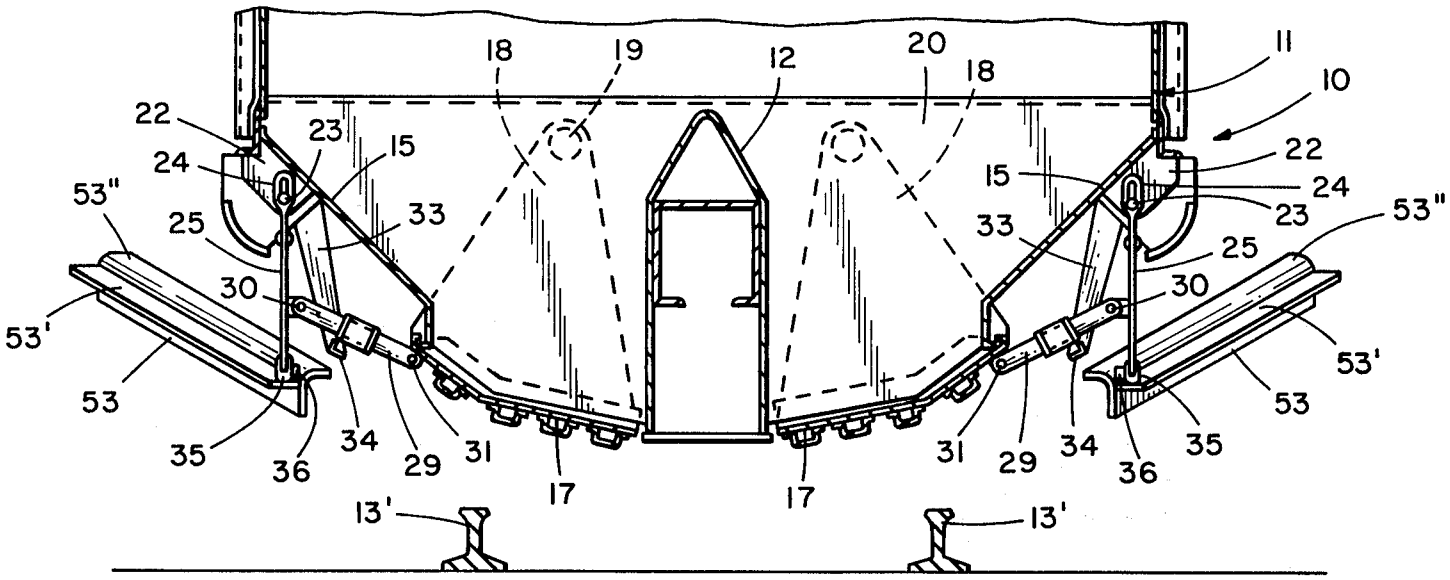
FIG. 7 is a cross sectional view taken substantially along the line 7—7 of FIG. 5.
Figure 8:
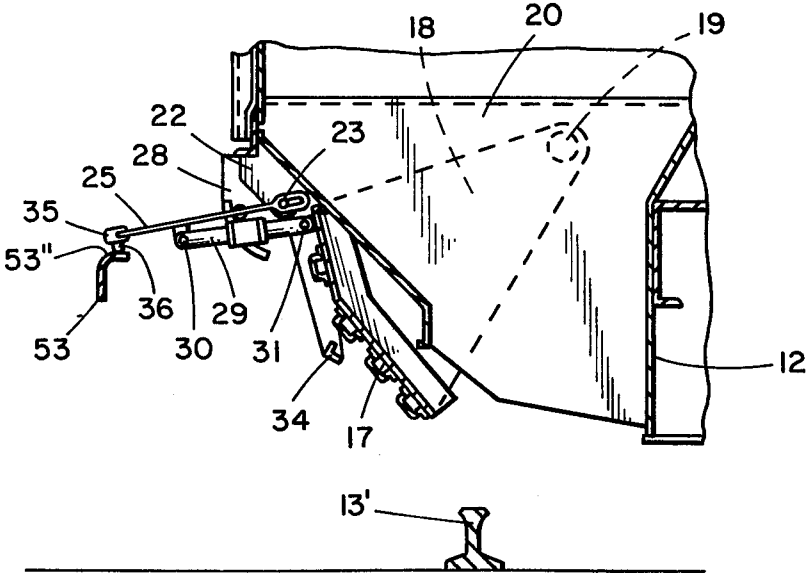
FIG. 8 is a view taken substantially along the line 8—8 of FIG. 5 showing an open position of the clam shell doors of a hopper car.

FIGS. 7 and 8 disclose an identical car body and door lock mechanism as shown in the aforementioned preferred embodiment and the same reference characters apply. FIGS. 5 and 6 however show a modified track side or ground mounted operating mechanism. Each side of the car is provided with elongated flanged tripping tracks 51 vertically spaced from the ground on supports 52. At one end of the arrangement there are provided hinged track portions 53 which are hingedly connected at 54 to each elongated flanged tripping track 51 so as to be pivoted upwardly as required by air cylinder, cylinder and piston units 55 similar to those disclosed in the preferred embodiment. As best shown in FIG. 7 the hinged track portions 53 are also flanged with a vertical flange portion 53' and a horizontal flange portion 53''. As shown in FIGS. 5 and 6 (to the left) another similar hinged track portion 53 is provided further down the track, the same also being actuated by means of cylinders and piston units 55. The hinged track portion 53 at this point also is hingedly connected as indicated at 54 to the elongated flange tripping track 51. The hinged track portion 53 also extends inwardly and longitudinally relative to the elongated flange tripping track 51 in the same manner as the aforementioned hinge track portion 53. A section of track designated at 56 forms an elongation of the tripping track 51 and is hinged for vertical hinged movement as indicated at 57. In the aligned position of the track 56 it provides a continuation of the track 51 and joins the hinged track portion 53 at a point designated at 58. In the operation of the presently described arrangement, as the car approaches the end of the tripping track the cylinders 55 are actuated to move upwardly whereupon as shown in FIG. 7 the horizontal flange 53' engages the roller 35 thus moving the arm 25 upwardly to disengage the link 29 from its stop relation with respect to the bracket 34 as described in the aforementioned preferred embodiment. Since the track 53 is disposed angularly continuance of the roller on the track 35 provides for outward movement of the arm 25 in the same manner as in the preferred embodiment thus providing for actuation of the link 29 to open the clam shell doors. The same operation is provided for by the hinged track portion 53 to the left of the arrangement shown in FIG. 5 since identical operation results to open the clam shell doors of the car adjacent thereto. During the upward movement of the track section 53, the hinged section 56 is pivoted upwardly about its hinge point 57 as the rollers and arms move between the space left between the sections 53 and 56 as the car moves to the left of FIG. 5 and the arms are displaced from between the track sections 53 and 56 and the track section 56 then again assumes the normal position forming a continuation of the track 51.

The foregoing description and drawings merely explain and illustrate the invention and the invention is not limited thereto, except insofar as the appended claims are so limited, as those skilled in the art who have the disclosure before them will be able to make modifications of variations therein without departing from the scope of the invention.

What is claimed is:

1. A railway hopper car having a pair of laterally spaced bottom discharge openings, doors pivotally connected to said car for swinging movement from a closed position over said openings outwardly to an open position, the improvement of a door actuating and locking mechanism for each door comprising;

an arm including means pivotally connecting said arm to said car for swinging movement from a vertically extending lock position laterally outwardly to an unlock position, a link pivotally connected to said arm and to said door.

said link having a stop element connected thereto, a stop bracket supported on said car engaged by said link stop in the lock position to lock said door against outward swinging movement, said means pivotally connecting said arm to said car providing for limited vertical movement thereof, and actuating means operable to move said arm verticaly thereby disengaging said link stop from said stop bracket and to swing said arm and door outwardly to an open position.

2. The invention in accordance with claim 1, said means pivotally connecting said arm to said car for limited vertical movement including a lost motion connection.

3. The invention in accordance with claim 1, said actuation means being ground-mounted adjacent to a railway track supporting said car.

4. The invention in accordance with claim 3, including a guide bracket supported on said car, and guide means on said arm engaging said guide bracket during outward lateral movement of said arm.

5. The invention in accordance with claim 3, said actuating means including a tripping track engageable with the lower portion of said tripping arm, and means for moving said tripping track laterally outwardly thereby swinging said arm and door to said open position.

6. The invention in accordance with claim 5, said tripping track being angle shaped with a horizontal flange and a vertical flange extending inwardly and upwardly with respect to the lower portion of said arm.

7. The invention in accordance with Claim 6, said lower portion of said arm including a first roller supported on said horizontal flange, and a second roller engaging said vertical flange.

8. The invention in accordance with claim 5, including means for moving said tripping track vertically into and out of engagement with respect to said arm.

9. The invention in accordance with claim 5, said means for moving said tripping track outwardly including power operated drive mechanism.

10. The invention in accordance with claim 9, including fluid actuated means for moving said tripping track and arm vertically.

11. The invention in accordance with claim 1, including a ground mounted stationary tripping track extending parallel to said track rails, a tripping track portion hingedly connected to said tripping track and extending angularly inwardly from said tripping track, and means for moving said tripping track upwardly into engagement with said arm to move the same vertically for disengaging said link stop.

12. The invention in accordance with claim 11, said tripping track portion having one end parallel to said tripping track, said other end hingedly connected to said ground mounted stationary track.

* * * * *